United States Patent [19]

Rudolf et al.

[11] Patent Number: 4,924,635

[45] Date of Patent: May 15, 1990

[54] PORTABLE GRINDER WITH ADJUSTABLE PROTECTIVE HOOD

[75] Inventors: Boris Rudolf; Walter Blutharsch, both of Stuttgart, Fed. Rep. of Germany

[73] Assignee: C. & E. Feini GmbH & Co., Fed. Rep. of Germany

[21] Appl. No.: 285,795

[22] Filed: Dec. 16, 1988

[30] Foreign Application Priority Data

Dec. 24, 1987 [DE] Fed. Rep. of Germany ..... 3744219

[51] Int. Cl.[5] ..... B24B 23/00; B24B 55/04

[52] U.S. Cl. ..... 51/170 R; 51/268

[58] Field of Search ..... 51/170 R, 170 PT, 170 T, 51/268

[56] References Cited

U.S. PATENT DOCUMENTS

| | | | |
|---|---|---|---|
| 1,850,137 | 3/1932 | Pursell | 51/170 R |
| 3,969,856 | 7/1976 | Zerrer | 51/268 |
| 4,059,930 | 11/1977 | Alessio | 51/268 |
| 4,060,940 | 12/1977 | DeWitt | 51/170 PT |
| 4,574,532 | 3/1986 | Haberle | 51/268 |

FOREIGN PATENT DOCUMENTS

| | | | |
|---|---|---|---|
| 7334640 | 9/1973 | Fed. Rep. of Germany . | |
| 3135820 | 4/1985 | Fed. Rep. of Germany . | |
| 3633943 | 4/1988 | Fed. Rep. of Germany . | |
| 3638337 | 5/1988 | Fed. Rep. of Germany | 51/268 |

OTHER PUBLICATIONS

*Huttle Maschinenbau,* Part A, vol. 28, p. 144.

*Primary Examiner*—Roscoe V. Parker

*Attorney, Agent, or Firm*—Kramer, Brufsky & Cifelli

[57] ABSTRACT

In a portable machine tool comprising a protective hood mounted by means of a holding part for rotation on a clamping neck of the portable machine tool, in order to prevent unintentional adjustment of the protective hood, it is proposed that the holding part of the protective hood and a locking part facing the holding part and held in a rotationally fixed manner on a grinder housing in the region of the clamping neck be provided with locking elements which can be brought into engagement with one another, that the holding part or locking part comprise at least one locking element and the respective other part several locking elements, and that the locking elements be disengageable against the force of a spring member.

13 Claims, 2 Drawing Sheets

PORTABLE GRINDER WITH ADJUSTABLE PROTECTIVE HOOD

The invention relates to a portable machine tool comprising a protective hood mounted by means of a holding part for rotation on a clamping neck of the portable machine tool, in particular, for a grinding tool of a portable angle grinder.

In a portable grinder known from German Patent 3 135 820, the protective hood is rotatably mounted on the clamping neck and held with axial play. A spring element which is prestressed in the axial direction and presses a securing ring of the protective hood against a shoulder surface on the clamping neck serves to compensate this play. The protective hood is thereby secured against turning by frictional engagement.

The disadvantage of this apparatus is to be seen in the fact that the protective hood can be adjusted inadvertently, particularly if one considers that such grinders are often used at places which are difficult to survey, yet the user must be sure that the protective hood is in the correct position and also remains in it.

The object underlying the invention is, therefore, to so improve a portable machine tool of the generic kind that unintentional adjustment of the protective hood, for example, due to pressure from the side, is no longer possible.

This object is achieved, in accordance with the invention, in a portable machine tool of the kind described at the beginning by the holding part of the protective hood and a locking part facing the holding part and held in a rotationally fixed manner on a grinder housing in the region of the clamping neck being provided with locking elements which can be brought into engagement with one another, by the holding part or the locking part comprising at least one locking element and the respective other part comprising several locking elements and by the locking elements being disengageable against the force of a spring member.

In contrast with the solution explained in connection with the prior art, the advantage of the inventive solution is to be seen in the fact that a positively engaging and rotationally fixed connection can be established between the holding part and the grinder housing by the locking elements which are engageable with one another so the protective hood can no longer rotate, and also in the fact that this connection is only releasable against the force of the spring member. Even if the locking elements should be disengaged unintentionally, it is still unlikely that the protective hood itself will also rotate at the same time.

In a particularly advantageous embodiment, the locking elements are detent recesses provided on one part and detent members provided on the other part, with the detent members being able to engage the detent recesses. In the simplest case, the detent recesses are bores while the detent member, in the simplest case, is a pin which engages these bores.

In one possibility of realizing the invention which is very easy to manufacture, one detent member and several detent recesses are provided and the single detent member is arranged on the holding part or locking part and the detent recesses on the respective other part.

In principle, the detent member itself could be displaceable towards the respective part on which it is arranged and be displaced, for example, by a special tool so as to either engage the detent recesses or not. A solution has proven particularly expedient in which the locking elements are stationarily arranged on the holding part and the locking part and in which the holding part and the locking part are tiltable relative to each other against the force of the spring member. This means that, in this case, the spring member does not act directly on the locking elements themselves but on the respective part which is tiltable relative to the respective other part. This may also result in structural simplifications.

In a concrete realization, the locking part carries the detent member and is arranged stationarily on the clamping neck while the holding part of the protective hood is provided with the detent recesses which can be disengaged from the detent body by tilting of the entire protective hood relative to the holding part.

It has proven particularly expedient for the holding part to be in the form of a ring which surrounds the clamping neck and is preferably integrally formed on the protective hood.

Similarly, the locking part can be a ring enclosing the clamping neck. It is, however, also conceivable for the locking part to advantageously take the form of a lever.

To enable tilting of the locking part relative to the holding part, it is conceivable for the locking part to be tiltably arranged relative to the clamping neck. In the simplest case, the corresponding holding part is then mounted in an untiltable manner on the clamping neck.

Alternatively or supplementarily to the tiltable mounting of the locking part, it is, however, also conceivable for the holding part to be tiltably arranged relative to the clamping neck and, within the scope of the inventive solution, either tilting in the axial or also in the radial direction of the clamping neck can be provided.

Particularly when the locking part is tiltably arranged relative to the clamping neck, provision is made for the locking part to comprise a lever with which tilting thereof can be carried out in a simple way. In order that the lever will not cause a disturbance when the inventive portable grinder is in use and will be accessible in a simple and ergonomically favorable manner, provision is made for the lever to extend between the protective hood and the grinder housing.

Regarding tiltable mounting of the locking part relative to the clamping neck, it is conceivable to mount the locking part thereon with play and to make it rest against a shoulder, for example, by means of a spring. It is, however, also conceivable for the locking part to be made of resilient material and hence to be fixedly arranged at one end on the clamping neck or on the grinder housing and by virtue of its own spring action to create the possibility for the locking part to be deformable to such a strong extent that the detent member can be disengaged from the detent recesses.

If, however, the tiltable mounting of either the holding part or the locking part should, in particular, be at the clamping neck, then in an expedient embodiment provision is made for the spring member to be a ring-shaped element which encloses the clamping neck and by means of which the respective tiltable part is made to rest against a shoulder.

Further features and advantages are the subject of the following description and of the appended drawings of several embodiments. The drawings show:

Figure 1:
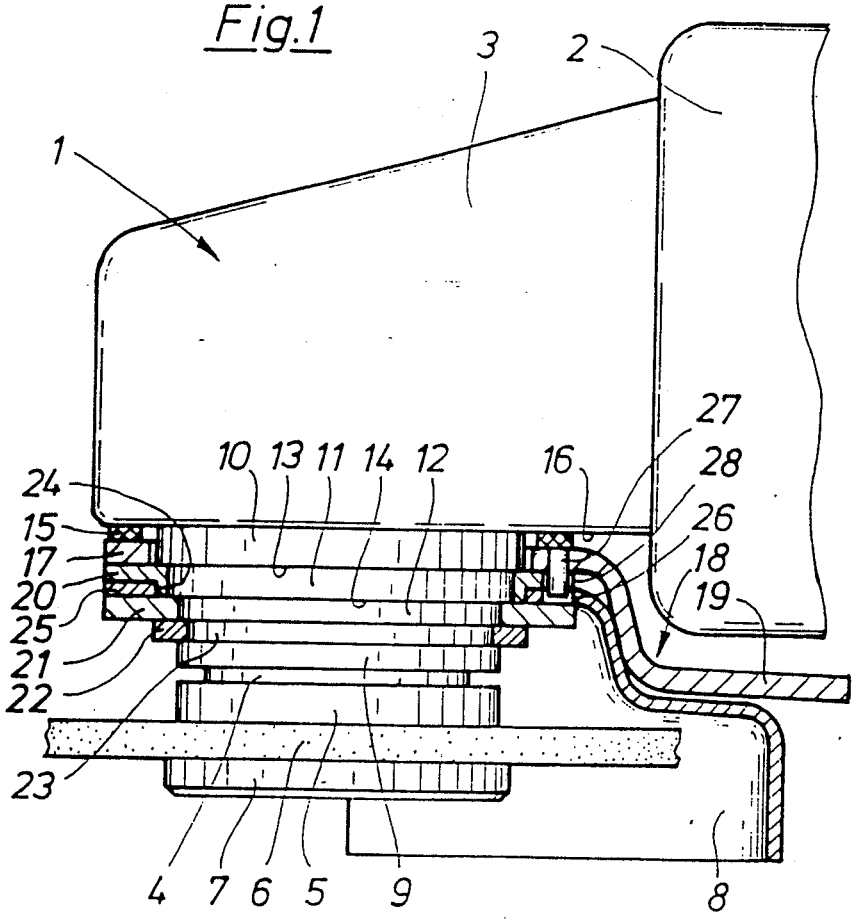
FIG. 1 is a side view of a front part of a first embodiment of an inventive portable grinder with a protective hood shown in cross-section.

An angle grinder designated in its entirety 1 in FIG. 1 comprises a motor housing 2 and a gear housing 3. A grinding spindle 4 carrying a clamping flange 5 at its end protrudes from the gear housing 3. A grinding disc 6 is placed on this clamping flange 5 and clamped against the clamping flange 5 by a counter flange 7 of a screw which can be screwed into the grinding spindle 4.

The grinding disc 6 is covered area-wise by a protective hood designated in its entirety at 8. The protective hood 8 is rotatably mounted on a clamping neck 9 mounted on the gear housing 3 and surrounding the grinding spindle 4 between the clamping flange 5 and the gear housing 3.

Starting from the gear housing 3, the clamping neck 9 is divided up into a total of three sections 10 to 12 which are coaxial with the grinding spindle 4. The external diameter of the sections 10 to 12 decreases progressively from the gear housing 3. Annular abutment surfaces 13 and 14 lying in planes extending perpendicularly to the axis of rotation of the grinding spindle 4 are thereby formed between these circular-cylindrical sections 10 to 12.

The first circular-cylindrical section adjacent to the gear housing 3 is surrounded by a spring element 15 which, on the one hand, is supported at a surface 16 formed by the gear housing 3 and extending perpendicularly to the axis of rotation of the grinding spindle 4 and, on the other hand, rests against a ring 17 likewise surrounding the first circular-cylindrical section 10. The ring 17 is part of a locking element designated in its entirety at 18 which also comprises a lever arm 19 formed on the ring 17 and extending in a space between the protective hood 8 and the motor housing 2. The ring 17 is pressed by the spring element 15 against an intermediate ring 20 seated on the second circular-cylindrical section 11. The intermediate ring 20, in turn, rests against the abutment surface 13 between the circular-cylindrical section 10 and the circular-cylindrical section 11 of smaller diameter. The intermediate ring 20 is, in turn, held by a fixing ring 21 which is seated on the third circular-cylindrical section 12 and rests against the abutment surface 14. This fixing ring 21 is held by a snap ring 22 which engages a circumferential groove 23 machined in the third circular-cylindrical section 12.

For mounting the protective hood 8, the intermediate ring 20 is provided on its side facing the fixing ring 21 with an annular recess 24 which is open in the radial outward direction and towards the fixing ring 21 and in which a ring-shaped holding part 25 of the protective hood 8 is rotatably but axially immovably mounted coaxially with the grinding spindle 4. This holding part 25 comprises bores 26 arranged at the same angular spacing on a circular arc segment. A pin 27 arranged on the locking part 18 in the region of the transition between the ring 17 and the lever arm 19 and extending from the locking part 18 through an opening 28 in the intermediate ring 20 to the holding part 25 engages one of these bores 26.

The ring 17 is held with play on the first circular-cylindrical section 10 so that the latter is axially displaceable in the direction of the gear housing 3 in relation to the grinding spindle 4 against the action of the spring element 15 which is, for example, a corrugated spring or a rubber ring. By actuating the locking part 18 in the region of the lever arm 19, the ring 17 in its entirety is tilted relative to the clamping neck 9 so far that the transition between the ring 17 and the lever 19 of the locking part 18 approaches the surface 16 of the gear housing 3 and hence the pin 27 arranged in this region is moved out of the bore 26 in the holding part 15 which it had engaged. In this case, the protective hood 8 which is rotatably mounted with the holding part 25 in the intermediate ring 20 can be turned freely around the clamping neck 9. After the lever arm 19 is released, the pin 27 is again moved in the direction of the holding part 25 by the spring element 15 and so it now engages the oppositely located bore 26 and fixes the holding part 25 with the protective hood 8 in a rotationally fixed manner on the clamping neck 9. This is effected by the pin 27 being non-rotatably fixed on the clamping neck 9 by the opening 28.

The walls of the bores 26 are expediently of such shape that even if strong pressure is exerted on the protective hood 8 from the side, the pin 27 cannot jump out of the bores 26. Furthermore, to enable locking of the protective hood 8 in all conceivable rotary positions, the bores 26 are expediently arranged in a large circumferential area on the holding part 25 and all lie with their center on a circular path segment which is concentric with the clamping neck 9.

Figure 2:
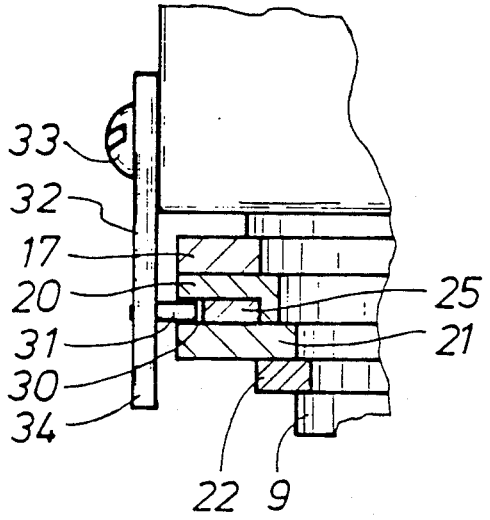
FIG. 2 is a partial view similar to FIG. 1 of a second embodiment.

A second embodiment, illustrated in FIG. 2, comprises a protective hood 8 which by means of the intermediate ring 20 and the fixing ring 21 is similarly mounted with its holding part 25 for rotation around the clamping neck 9.

Insofar as the same parts are provided as in the first embodiment, the same reference numerals are also used. Therefore, for an explanation of these, reference is made to the above statements.

In contrast with the first embodiment, the holding part 25 is not provided with bores 26 arranged coaxially with the grinding spindle 4, but with recesses 30 extending radially from an outer side of the holding part 25 in the direction towards the clamping neck 9 and preferably being provided in the circumferential area of the holding part 25 which does not pass over into the protective hood 8.

A pin 31 oriented in the radial direction towards the clamping neck 9 engages these recesses 30. The pin 31 is held on a lever 32 made of elastic material and extending parallel to an axial direction of the clamping neck 9 on an outer side thereof so the pin 31 protrudes from this lever 32 in the direction of the holding part 25. The lever 32 is preferably made of elastic material and held, for example, by a screw 33 on the gear housing 3. By bending the lever 32 radially outwardly in relation to the clamping neck 9, the pin 31 can be disengaged from the recess 30, whereby the protective hood 8 is rotatable on the clamping neck. For actuation of the lever 32, it is preferably provided with a tongue 34 extending beyond the pin 31 and forming a front end thereof. The tongue 34 permits simple actuation of the lever 32.

Hence in contrast with the first embodiment, the lever 32 forms the locking element and replaces the lever 18 of the first embodiment.

Figure 3:
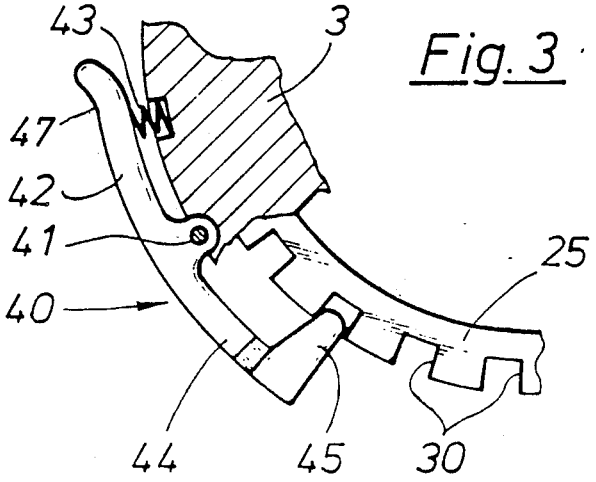
FIG. 3 is a partial cross-section through a clamping neck of a third embodiment in a plan view of the protective hood.

In a third embodiment, illustrated in FIG. 3, the holding part is of identical design to that of the second embodiment and similarly comprises recesses 30 which extend in the radial direction towards the clamping neck 9 and are open towards the outside.

However, in contrast with the second embodiment, a tilting lever 40 mounted on the gear housing 3 for rotation about an axis 41 parallel to the axis of rotation of the grinding spindle 4 is provided. A first lever arm 42 arranged on one side of the axis of rotation 41 rests against a spring 43 which is supported at its opposite side on the gear housing 3 and thereby urges the first lever arm 42 away from the gear housing. A second lever arm 44 arranged opposite the first lever arm 42 with respect to the axis of rotation 41 is thereby urged in the direction towards the clamping flange 9 and so a pin 45 arranged on the front end of the second lever arm 44 is held in engagement with one of the recesses 30 in order to lock the holding part 25. To arrange the pin 45 such that it can engage the recesses 30, the lever arm 44 must be bent in the axial direction of the clamping neck 9.

The lever 40 is preferably provided at a rear end of the first lever arm 42 opposite the axis of rotation 41 with a pressure surface 47 which allows it to be acted upon and hence the pin to be disengaged from the recesses 30. Accordingly, after the pressure surface 47 has been acted upon, the protective hood 8 can be turned and after release of the pressure surface 47, the pin 45 can snap into one of the recesses 30 again in order to lock the protective hood 8 in a rotationally fixed manner.

What is claimed is:

1. Portable machine tool, comprising:

a grinder housing having a clamping neck, a protective hood mounted by means of a holding part for rotation on said clamping neck of said portable machine tool, a locking part facing said holding part and held in a rotationally fixed manner on said grinder housing, said holding part of said protective hood and said locking part being provided with locking elements, said holding part or said locking part comprising at least one first locking element and said respective other part several second locking elements, said first locking element being able to be brought into positive engagement with every one of said second locking elements, each engagement of said first locking element with one of said second locking elements fixing said protective hood in one definite position relative to said grinder housing and said locking elements being designed to be disengaged against the force of a spring member.

2. Portable machine tool as defined in claim 1, characterized in that said locking elements are detent recesses provided on one part and a detent member provided on the other part.

3. Portable machine tool as defined in claim 2, characterized in that one detent member and several detent recesses are provided.

4. Portable machine tool as defined in claim 1, characterized in that said locking elements are stationarily arranged on said holding part and said locking part, and in that said holding part and said locking part are tiltable relative to one another against the force of said spring member.

5. Portable machine tool as defined in claim 1, characterized in that said holding part is in the form of a ring surrounding said clamping neck.

6. Portable machine tool as defined in claim 5, characterized in that said holding part is integrally formed on said protective hood.

7. Portable machine tool as defined in claim 1, characterized in that said locking part is a ring enclosing said clamping neck.

8. Portable machine tool as defined in claim 1, characterized in that said locking part is tiltably arranged relative to said clamping neck.

9. Portable machine tool as defined in claim 1, characterized in that said holding part and the locking part are tiltably arranged relative to each other.

10. Portable machine tool as defined in claim 1, characterized in that said locking part comprises a lever.

11. Portable machine tool as defined in claim 10, characterized in that said lever extends between said protective hood and said grinder housing.

12. Portable machine tool as defined in claim 1, characterized in that said locking part is made of resilient material.

13. Portable machine tool as defined in claim 1, characterized in that said spring member is a ring-shaped element enclosing said clamping neck.

* * * * *

UNITED STATES PATENT AND TRADEMARK OFFICE

CERTIFICATE OF CORRECTION

PATENT NO. : 4,924,635

DATED : May 15, 1990

INVENTOR(S) : Boris Rudolf and Walter Blutharsch

It is certified that error appears in the above-identified patent and that said Letters Patent is hereby corrected as shown below:

Under Assignee:

Delete: "C. & E. Feini GmbH & Co."

Add: -- C. & E. Fein GmbH & Co. --

Signed and Sealed this

Sixth Day of August, 1991

*Attest:*

HARRY F. MANBECK, JR.

*Attesting Officer*

*Commissioner of Patents and Trademarks*